United States Patent [19]

Pratt

[11] 4,255,090

[45] Mar. 10, 1981

[54] MANUFACTURE OF POWERED AIR COMPRESSORS

[76] Inventor: Anthony M. J. Pratt, The Bracken, Waterhouse La., Kingswood, Surrey, England

[21] Appl. No.: 78,101

[22] Filed: Sep. 24, 1979

[30] Foreign Application Priority Data

Sep. 25, 1978 [GB] United Kingdom ..... 37989/78

[51] Int. Cl.[3] ..... F04B 41/04

[52] U.S. Cl. ..... 417/53; 417/237; 417/238

[58] Field of Search ..... 417/236, 237, 238, 53; 123/198 F

[56] References Cited

U.S. PATENT DOCUMENTS

| | | | |
|---|---|---|---|
| 2,955,750 | 10/1960 | Phelps | 123/198 F |
| 3,136,478 | 6/1964 | Soumerai | 417/238 X |
| 3,963,379 | 6/1976 | Ueno | 417/237 |

*Primary Examiner*—Carlton R. Croyle
*Assistant Examiner*—Edward Look
*Attorney, Agent, or Firm*—Mason, Fenwick & Lawrence

[57] ABSTRACT

The conversion of a multi-cylinder liquid cooled internal combustion engine into a powered air compressor by placing inserts into parts of the cylinder head above certain of the cylinders after removal of the valve gear therefrom. The insert seals the coolant jacket in the cylinder head and provides surfaces for receiving a proprietary air compressor valve. The insert may be arranged to connect with ports in the cylinder head in which case the engine manifolding must be modified to separate the compressor air flows from the engine gases, although where the engine receives air as an inlet gas (e.g. a diesel engine) the inlet manifold can be used to provide air to the converted cylinders as well. The cylinders selected for conversion should be chosen having regard to the balance and smoothness of running of the remaining cylinders used to drive them.

21 Claims, 3 Drawing Figures

MANUFACTURE OF POWERED AIR COMPRESSORS

This invention relates to the manufacture of powered air compressors and in particular to air compressors driven by internal combustion engines.

It is well known to drive a reciprocating air compression pump by means of a reciprocating internal combustion engine. It has also been proposed to substitute for the cylinder head of one cylinder of a multi-cylinder air cooled diesel engine an air compressor cylinder head so that, for example, instead of having a two-cylinder diesel engine the machine is converted into a single cylinder diesel engine with a single cylinder air compressor. Another alternative that has been proposed is the manufacture of a special cylinder head for a multi-cylinder engine in which the parts of the head for certain of the cylinders are conventional internal combustion engines and their heads, and the cylinder head for one or more cylinders is constructed as for a reciprocating air compressor. It will be appreciated that all of these arrangements are relatively expensive and in particular the difficulties involved in the construction of the last mentioned cylinder head were such that the resulting powered air compressor was of substantially the same cost as an air compressor driven by a separate internal combustion engine. The provision of a different cylinder head for one cylinder of an air-cooled diesel engine is less expensive but the initial cost of an air-cooled diesel engine is higher than that of a water-cooled engine, thus offsetting the saving.

It is an object of the present invention to provide an air compressor integral with a multi-cylinder internal combustion engine in which the above disadvantages are substantially reduced.

According to one aspect of the present invention there is provided a method of manufacturing a powered air compressor including providing a multi-cylinder liquid cooled internal combustion engine, machining one or more openings in the cylinder head of the engine above respective cylinders, attaching an insert in the or each opening suitable for receiving an air compressor valve, each insert being such as to seal the holes through the coolant jacket walls in the cylinder head resulting from the formation of the particular opening, and attaching an air compressor valve to the insert.

The or each opening may be of cylinderical or stepped cylinderical form and may be produced by boring. The compressor valve may be of a commercially available type such as a flat circular arrangement with concentric annular air ports for outgoing and incoming air to the cylinder. Finger valves or multi valves may be used. The valve may incorporate an air compressor unloader for regulating the pressure of the compressed air produced.

According to a second aspect of the invention there is provided a powered air compressor comprising a multi-cylinder liquid cooled internal combustion engine having a cylinder head in which the valve gear and part of the cylinder head for at least one cylinder are removed, an insert attached to the cylinder head to seal the holes through the coolant jacket walls produced by the removal of the part of the cylinder head for each such cylinder and a compressor valve fitted to the insert, the arrangement being such that the or each cylinder with a compressor valve operates as an air compressor driven by the remaining cylinders of the engine.

The insert may be such that it passes right through the cylinder head parallel to the cylinder axis and it may provide an inlet passage and/or an outlet passage for air of the compressor through the top of the cylinder head. The insert may include one or more lateral passages which can be aligned with inlet and/or exhaust ports formed in the cylinder head so that the ports provided in the head for the engine are used for passing air to and/or from the compressor. If the inlet and/or exhaust ports are used in this way, it would of course be necessary to modify the inlet and/or exhaust manifolds of the engine to separate the compressor air flows from the engine gases.

Instead of passing right through the cylinder head, the insert may be shaped to fit a blind opening in the cylinder head and arranged to use the inlet and exhaust ports as described above.

The internal combustion engine used is preferably a diesel engine, and in one example the engine was a mass produced four-cylinder in-line liquid cooled unit of which the outer two cylinders were converted to operate as air compressors.

In selecting the cylinders to be converted to operate as air compressors, it is important to consider the balance and evenness of firing of the remaining cylinders of the engine so that excessive vibration is avoided.

If the engine is such as to employ combustion chambers formed in the pistons, it is desirable to fit blanking plates over the combustion chambers of the pistons of the converted cylinders so that the efficiency of the cylinders as air compressors is not reduced by the presence of the combustion chambers. The blanking plate may be fitted by being made slightly dished and retained in the piston by being pressed down to a concave shape so as to engage with the periphery of a recess made to receive the plate.

The or each insert may be attached to the cylinder head by being inserted whilst shrunk by cooling. Adhesives or sealants may alternatively or additionally be used to seal the joints between the insert and the head.

In order that the invention may be fully understood and readily carried into effect, it will now be described with reference to the accompanying drawings, of which:

Figure 1:
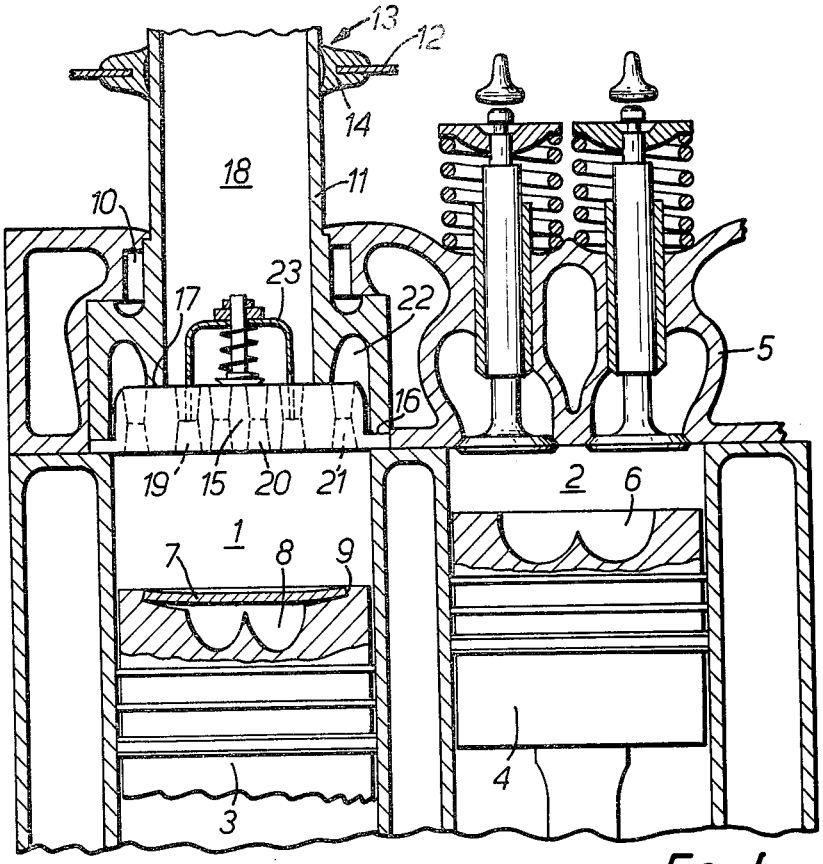
FIG. 1 shows partly in cross-section adjacent cylinders of a multi-cylinder in-line liquid cooled diesel engine, one cylinder being left to operate as part of the engine and the other cylinder being converted to act as an air compressor according to one example of the invention.
Figure 3:
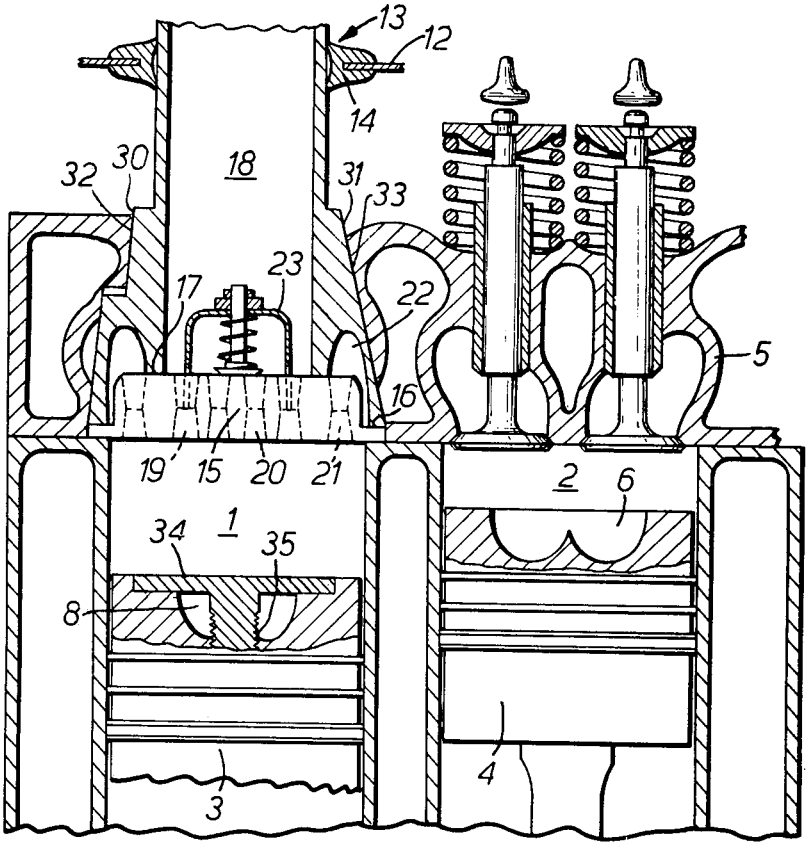
FIG. 3 shows modifications to the example of FIG. 1.

FIG. 1 shows cylinders 1 and 2 of a four-cylinder in-line water cooled diesel engine, with pistons 3 and 4 running in them. A cast cylinder head 5 is provided common to all of the cylinders of the engine. The cylinder 2 is unconverted and operates as part of a diesel engine having vertical inlet and exhaust valves operates, for example, by push rods and rockers not shown and having a combustion chamber 6 formed in the crown of the piston 4. The cylinder 1, however, has been converted to operate as an air compressor, and a blanking plate 7 is provided fitted into the crown of the piston 3 so as to cover the combustion chamber 8 of that piston. The blanking plate 7 is formed slightly dished and is held in position by being pressed down to concave form so as to engage with the slightly incut periphery of a circular recess 9 cut in in the crown of the piston 3. Alternatively the combustion chamber in the piston could be blanked with a screwed plug like 34 shown in FIG. 3 screwed into a threaded hole 35 in the piston. In the cylinder head 5 above the piston 1, the valve gear having been removed, a stepped cylinderical opening 10 is formed extending through the cylinder head in line with the axis of the cylinder 1. An insert 11 is fitted into the opening 10 and is shaped to seal the holes produced in the walls of the water contained passages of the cylinder head 5 produced when the opening 10 was cut. In addition, the insert 11 is arranged to ensure that the water circulation withing the head is not substantially impaired. Part of a rocker cover 12 is shown, a circular hole 13 being cut in it and a grommet 14 being fitted to prevent leakage of lubricant. A compressor valve 15 of conventional form is fitted to the insert 11 which is provided with an outer abutment 16 against which the valve 15 rests and an inner abutment 17 serving to separate the inlet and outlet passages connected to the valve 15. The interior 18 of the main part of the insert 11 serves as an inlet passage for air to the compressor, the valve 15 having two concentric annular ports 19 and 20 containing valves permitting air to flow from the passage 18 into the interior of the cylinder 1. The valve 15 includes a further annular port 21 provided outside the ports 19 and 20 with a valve permitting air to flow from the cylinder 1 into an annular space 22 bounded by the part of the insert 11 between the abutments 16 and 17 and the outer part of the valve 15. Not shown in the drawing is an opening in the outer wall of the insert 11 which couples the space 22 to the residue of either the inlet port or the exhaust port provided in the cylinder head 5 for the cylinder 1. Alternatively two such openings could be provided so that both inlet and exhaust ports in the head 5 are used for outlet air from the cylinder 1. It will be appreciated that the inlet and exhaust manifolds of the engine must be modified to separate the air outlet from the cylinder 1 from the gases of the cylinders operating as a diesel engine.

The compressor valve 15 can be provided with a spring loaded unloading mechanism 23 which when operated, for example, by means of a rod running vertically down the passage 18, overrides the operation of the inlet valves in the ports 19 and 20 so that either these valves are kept open or kept closed, so that the compressor no longer pumps air, when maximum air pressure is reached.

The insert 11 may be of the same material as the cylinder head 5 and thereby avoid problems with differential thermal expansion and electrolytic corrosion by the coolant fluid. Alternatively the insert 11 may be of a different material from the cylinder head 5 provided it is such that the effects of differential expansion and electrolytic corrosion are tolerable. Although in the example described above with reference to FIG. 1 of the drawings the insert 11 is stepped to provide sealing of the joint faces between the insert 11 and the head 5, the insert 11 may be shaped in other ways, for example, it may be tapered as shown at 31 in FIG. 3 or stepped and tapered as shown at 30 in FIG. 3, and the opening 10 modified correspondingly as shown at 33 or 32 respectively in that Figure so as to give a better seal between the insert 11 and the head 5 because the insert can be pushed further into the opening in the head to press the joint faces together.

In an alternative arrangement the air flow through the compressor valve 15 can be reversed and the annular space 22 coupled to the inlet port only so that the manifolds of the engines need not be modified, the air compressor drawing air through the inlet manifold of the diesel engine and driving the outlet air upward through the passage 18.

Figure 2:
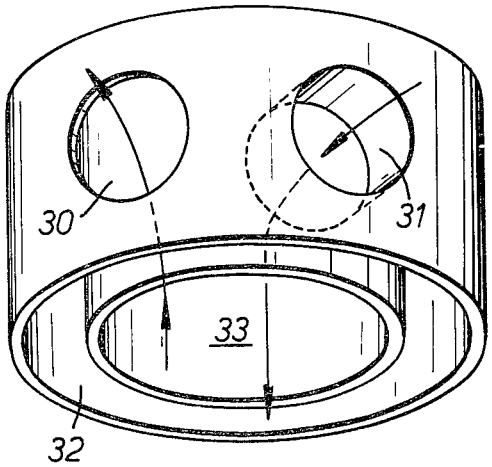
FIG. 2 shows one example of an insert suitable for fitting into a blind opening in a cylinder head.

FIG. 2 shows an alternative form for the insert which is intended to be fitted into a blind opening formed in the cylinder head and which uses the inlet and exhaust ports formed in the cylinder head as air flow ports for the compressor. As will be apparent from the drawing, the outer wall of the insert shown in FIG. 2 has two openings 30 and 31 of which the opening 30 communicates with the outer annular chamber 32 of the insert and the other opening 31 communicates with the inner chamber 33. This insert is intended for use with a compressor valve similar to that indicated in FIG. 1. Of course, the opening 10 in the cylinder head 5 would not extend through the head as in FIG. 1, but would have suitable faces machined at the bottom so that the insert can seal the coolant passages.

Although the invention has been described with reference to two specific embodiments, it will be appreciated that many changes could be made without departing from the invention. For example, instead of using either of the ports in the cylinder head 5, the passage 18 of the insert 11 shown in FIG. 1 could be divided into two, one part being provided for the air inlet and the other for the air outlet being coupled to the annular space 22.

What I claim is:

1. A method of manufacturing a powered air compressor including providing a multi-cylinder liquid cooled internal combustion engine, machining one or more openings in the cylinder head of the engine above respective cylinders, attaching an insert in the or each opening suitable for receiving an air compressor valve, each insert being such as to seal the holes through the coolant jacket walls in the cylinder head resulting from the formation of the particular opening, and attaching an air compressor valve to the insert.

2. A method according to claim 1 wherein the or each insert includes a first passage for air incoming to the respective cylinder through the air compressor valve, and a second passage for air outgoing from the cylinder through the air compressor valve, the air compressor being fitted to the insert so that it fits against abutment means in the insert to separate the first and second passages.

3. A method according to claim 2 wherein the or each insert is arranged so that at least one of the first and second passages connects with a port in the cylinder head, and an engine manifold is modified to allow for the use of each such port for air instead of engine gases.

4. A method according to claim 3 wherein the or each insert includes a tubular portion connected to one or both of the first or second passages, and the or each opening in the cylinder head machined to receive an insert passes through the cylinder head so that when fitted the tubular portion of the insert projects from the cylinder head.

5. A method according to claim 3 wherein the opening is of cylinderical or stepped cylinderical form and is produced by boring the cylinder head.

6. A method according to claim 3 wherein the opening is of tapered or stepped and tapered form and the insert is shaped correspondingly so that joint faces between the insert and the cylinder head are pressed together when the insert is pushed into the opening.

7. A method according to claim 3 including fitting a blanking plate to cover a combustion chamber in the piston of the or each cylinder converted to air compression.

8. A method according to claim 7 wherein the blanking plate is sprung into a recess cut in the piston crown so that the edge of the plate engages the periphery of the recess.

9. A method according to claim 7 wherein the blanking plate is provided with screw means securing it to the piston.

10. A method according to claim 7 wherein the or each insert into the cylinder head is retained by differential thermal expansion.

11. A method according to claim 7 wherein the or each insert is made of substantially the same material as the cylinder head.

12. A powered air compressor comprising a multi-cylinder liquid cooled internal combustion engine having a cylinder head in which the valve gear and part of the cylinder head for at least one cylinder are removed, an insert attached to the cylinder head to seal the holes through the coolant jacket walls produced by the removal of the part of the cylinder head for each such cylinder and a compressor valve fitted to the insert, the arrangement being such that the or each cylinder with a compressor valve operates as an air compressor driven by the remaining cylinders of the engine.

13. A compressor according to claim 12 wherein the insert has a first passage for air incoming to the cylinder through the compressor valve, a second passage for air outgoing from the cylinder through the compressor valve and abutment means against which the compressor valve fits to separate the first and second passages.

14. A compressor according to claim 13 wherein one or both of the first and second passages connects with a port or ports in the cylinder head, and the inlet and/or exhaust manifold of the engine is modified to separate the compressor air flows from the engine gas flows.

15. A compressor according to claim 14 wherein the insert passes right through the cylinder head and has a tubular portion connected to one or both of the first and second passages which portion projects from the top of the cylinder head.

16. A compressor according to claim 15 wherein a blanking plate is fitted over a combustion chamber in the piston of each cylinder converted to operate as an air compressor.

17. A compressor according to claim 16 wherein the blanking plate is sprung into a recess cut in the crown of the piston so that its edge engages the periphery of the recess.

18. A compressor according to claim 16 wherein the blanking plate is secured to the piston by screw means.

19. A compressor according to claim 12 wherein the insert is so shaped and the opening cut in the cylinder head to receive it shaped correspondingly that joint faces between the insert and the cylinder head are pressed together when the insert is pushed into the opening.

20. A compressor according to claim 18 wherein the insert and the opening are of stepped, tapered or stepped and tapered form.

21. A compressor according to claim 12 having four cylinders in which the outer two cylinders are converted to act as air compressors driven by the inner two cylinders.

* * * * *